US005315978A

United States Patent [19]

Ishida

[11] Patent Number: 5,315,978

[45] Date of Patent: May 31, 1994

[54] FUEL INJECTION SYSTEM

[75] Inventor: Akio Ishida, Yokohama, Japan

[73] Assignee: Mitsubishi Jidosha Kogyo Kabushiki Kaisha, Tokyo, Japan

[21] Appl. No.: 36,735

[22] Filed: Mar. 25, 1993

[30] Foreign Application Priority Data

Mar. 25, 1992 [JP] Japan ..... 4-067627

[51] Int. Cl.[5] ..... F02M 41/00

[52] U.S. Cl. ..... 123/467; 123/506; 417/495

[58] Field of Search ..... 123/467, 506, 500, 501, 123/503, 447; 417/495, 494, 499

[56] References Cited

U.S. PATENT DOCUMENTS

| | | | |
|---|---|---|---|
| 3,435,811 | 4/1969 | Guertler | 123/503 |
| 3,677,256 | 7/1972 | Regneault | 123/503 |
| 3,810,453 | 5/1974 | Wolfe | 123/467 |
| 4,271,808 | 6/1981 | Kobayashi | 123/506 |
| 4,651,779 | 3/1987 | Filippi | 123/506 |
| 4,805,580 | 2/1989 | Buisson | 123/467 |
| 5,067,880 | 11/1991 | Finsterwalder | 123/506 |
| 5,197,437 | 3/1993 | Dahlmann | 123/447 |
| 5,209,208 | 5/1993 | Siebert | 123/503 |
| 5,224,846 | 7/1993 | Kirschner | 123/501 |

FOREIGN PATENT DOCUMENTS

| | | | |
|---|---|---|---|
| 531784 | 8/1931 | Fed. Rep. of Germany | 123/467 |
| 0249664 | 12/1985 | Japan | 123/467 |

*Primary Examiner*—Carl S. Miller

[57] ABSTRACT

A fuel injection system which can effectively control a residual pressure in an injection pump so as to reduce soot and hydrocarbons in an exhaust gas when an engine is operating at a low speed. The fuel injection system features a structure in which a passage is formed in a plunger barrel, extends between a delivery valve chamber and a pressurization source, and is in communication with these chambers via a plunger when it is in contact with a base circle of a cam.

40 Claims, 13 Drawing Sheets (NON-FEEDING OF FUEL UNDER PRESSURE)

(START OF FUEL FEEDING UNDER PRESSURE)

(FUEL BEING FED UNDER PRESSURE)

(COMPLETION OF FUEL FEEDING UNDER PRESSURE)

(NON-FEEDING OF FUEL UNDER PRESSURE)

(START OF FUEL FEEDING UNDER PRESSURE)

(FUEL BEING FED UNDER PRESSURE)

(COMPLETTION OF FUEL FEEDING UNDER PRESSURE)

FUEL INJECTION SYSTEM

BACKGROUND OF THE INVENTION

1. Field of the Invention

This invention relates in general to a fuel injection system, and more particularly to a structure for controlling the residual pressure in a fuel injection pump.

2. Description of the Related Art

As is well-known in the art, an in-line fuel injection pump for use in a diesel engine has a structure for feeding fuel under pressure. As shown in FIGS. 10 and 11 of the accompanying drawings, the inline fuel injection pump A includes a plunger D which is made to slide in a plunger barrel by a cam B. The plunger D feeds fuel to an injection pipe when the pressure of fuel becomes large enough to open a delivery valve E. Then, when the pressure of fuel in the oil pipe is large enough to open an injection nozzle connected to the injection pipe, fuel is injected into an engine cylinder.

On the other hand, when the plunger D moves upwardly and an opening F of the plunger D communicates with a port G of a sleeve C1, the pressure in a pressurization chamber H is reduced.

Referring to FIG. 11, the delivery valve E is closed by the pressure of its own return spring E1, thereby preventing reverse flow of fuel to the fuel injection pump A from the injection nozzle, increasing the capacity of the delivery valve chamber while the delivery valve is in its return stroke so as to lower the pressure in the delivery valve chamber, and lowering the pressure in the injection pipe connected to the valve chamber.

Fuel is instantaneously injected into the engine cylinder so as to prevent fuel from dripping into the cylinder after injection.

Fuel is confined in the injection pipe after it is injected into the cylinder. Therefore, a part of pressure applied to fuel is retained in the injection pipe as residual pressure.

The residual pressure represents a static pressure that exists when the pressurizing process is stabilized after one fuel injection process, and varies with engine operating conditions to determine factors such as an engine speed and the quantity of fuel injection.

The residual pressure is reduced when the quantity of injected fuel is larger than the quantity of fuel under pressure fed by the plunger to the delivery chamber. Otherwise, the residual pressued is increased.

When the residual pressure varies, transmission of the pressure for next fuel injection also varies in the injection pipe, so that the injection pressure will be changed accordingly.

When the return spring of the delivery valve has a preset constant pressure, variation of the residual pressure would cause differences in the pressure lowered during the return of the delivery valve. Fuel becomes foamy due to the reduction of the pressure in the injection pipe. Unfortunately, sometimes fuel is so extensively foamy that cavitation erosion will be remarkably caused when fuel foams are destroyed under pressure.

When the engine speed is low, the plunger moves so slowly to adversely affect the injection pressure. The lower the injection pressure, the less effectively fuel is changed to mist of fine fuel particles. Such fuel tends to produce a lot of particulates in an exhaust gas and soot.

This phenomenon is shown in FIGS. 12 and 13. FIG. 12 shows the relationship between a particulate diameter and injection pressure. FIG. 13 shows the quantity of particulates depending upon the injection pressure.

There has been proposed a structure to increase the pressure for opening the delivery valve regardless of the residual pressure varying depending upon the injection characteristics which are set according to the engine operating status. Then, the pressure applied to fuel is kept in the injection pipe so that fuel is injected under that pressure when the injection nozzle is opened.

Such a structure however requires an additional member such as an oil path for keeping the pressure, and a pump in the fuel chamber to keep the pressure, which makes the fuel injection system more complicated.

Further, there is a proposal in which a nonreturn valve is disposed to feed fuel to the delivery valve chamber so as to preliminarily pressurize the chamber when the residual pressure is lowered. In such a structure, fuel has to flow only in one direction in the delivery valve chamber.

Therefore, it is impossible not only to adjust the pressure as desired in the delivery valve chamber but also to increase the injection pressure depending upon the engine speed. This implies that a high pressure cannot be realized for the fuel injection in an engine speed range where fuel has to be extensively pressurized to decrease particulates in the exhaust gas.

SUMMARY OF THE INVENTION

It is therefore an object of the invention to provide a fuel injection system which can solve the foregoing problems related to the residual pressure in the fuel injection pump and reduce soot and hydrocarbons at a low engine speed.

Another object of the invention is to provide the fuel injection system which can control the residual pressure without extensive modification of the conventional in-line fuel injection pump.

According to the invention, a fuel injection system for a diesel engine adopts an in-line fuel injection pump and features that a passage is formed in a plunger barrel, has its one end in communication with a delivery valve chamber of a delivery valve in the injection pump and the other end thereof in communication with a pressure souce, and has a part thereof in communication with a plunger when the plunger is in contact with a base circle of a cam.

When the plunger is in contact with the base circle of the cam, the plunger has an annular groove on the circumferential surface thereof, which is in communication with the passage.

The annular groove is out of communication with the passage when the plunger is in contact with the cam at a portion other than the base circle thereof.

The pressure source at one end of the passage comprises a pump element for one cylinder of the injection pump.

When the plunger is in contact with the base circuit of the cam, fuel is fed into the delivery valve chamber so as to preliminarily pressurize the delivery valve chamber.

Further, when the plunger is in contact with the cam at a portion other than the base circle thereof, the passage to the delivery chamber is blocked. Thus, the plunger serves as a valve for opening and closing the passage.

The pump element for one cylinder in the injection pump is used as a structure for increasing the pressure in the injection pipe and the pressure for opening the delivery valve. Therefore, no pump other than the injection pump will be necessary to preliminarily pressurize the delivery valve chamber.

DETAILED DESCRIPTION OF THE PREFERRED EMBODIMENT

Figure 1:
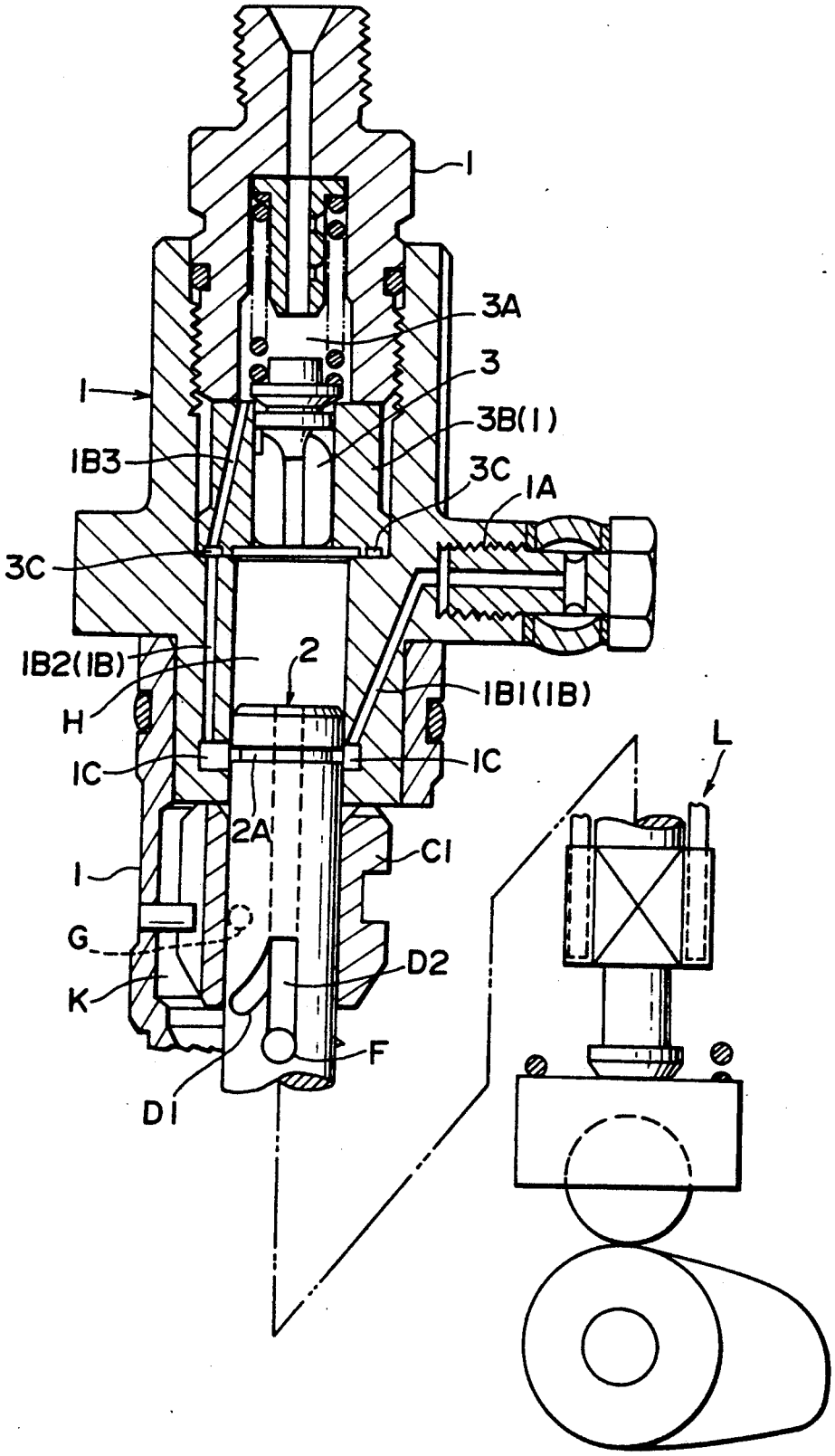
FIG. 1 is a cross-sectional view of a pump element used in a fuel injection system according to an embodiment of the invention.
Figure 2:
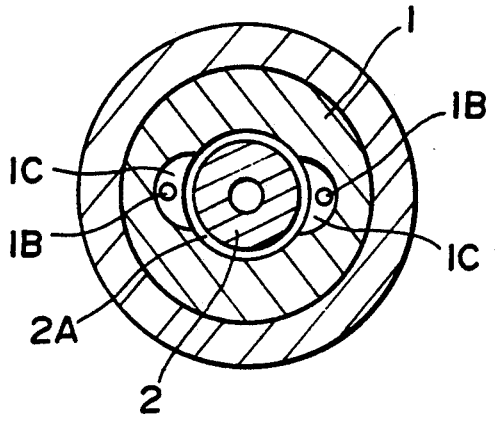
FIG. 2 is a cross-sectional view taken on a plane indicated by and viewed in the direction of the arrows 2—2 of FIG. 1.

The invention will be described with reference to an embodiment shown in FIGS. 1 to 9 and 14 to 16. FIG. 1 shows the main part of a pump element for the fuel injection pump of FIG. 10. The pump element comprises a plunger barrel 1, a plunger 2 and a delivery valve. The plunger barrel 1 serves as a housing.

The pump element is designed so as to change the positional relationship between a plunger reed of the plunger and a spill port of a plunger barrel, thereby changing the pre-stroke. The plunger reed faces with the spill port.

The pump element further includes a control sleeve C1 which is housed in the plunger barrel 1 and is slidable axially in the plunger 2, and a driver I for displacing the control sleeve C1. A space around the control sleeve C1 serves as a fuel chamber K to which fuel is supplied from a fuel tank.

The control sleeve C1 is axially movable in the plunger 2 by the driver I in response to the turning of a control rod J when a pin G1 fixed to the control rod J is fitted into a cavity on the circumferential surface of the control sleeve C1. The axial movement of the control sleeve C1 varies the pre-stroke of the plunger. For this purpose, a member such as a rotary solenoid is used for the driver I. An injection timing control member includes the control rod J, the driver I and other components.

Figure 10:
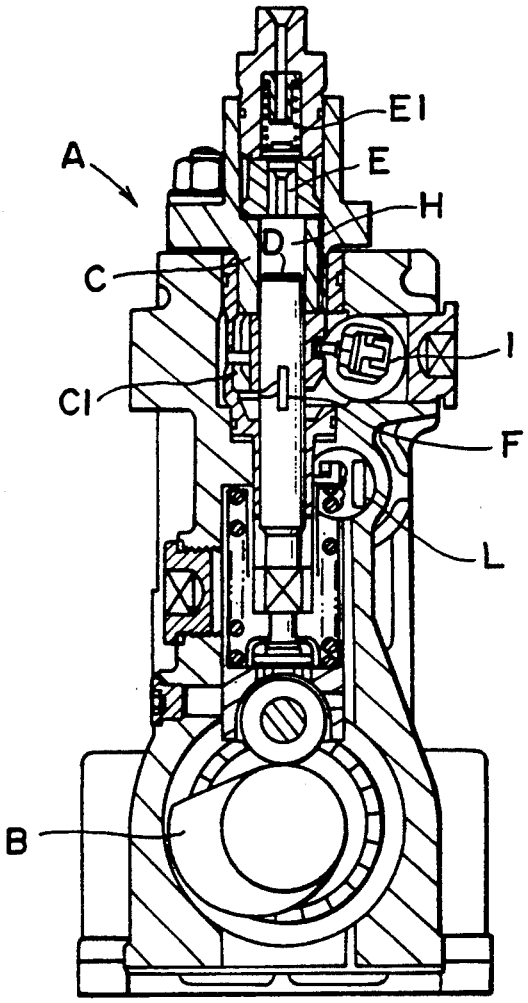
FIG. 10 is a cross-sectional view showing an example of the conventional in-line fuel injection pumps.
Figure 11:
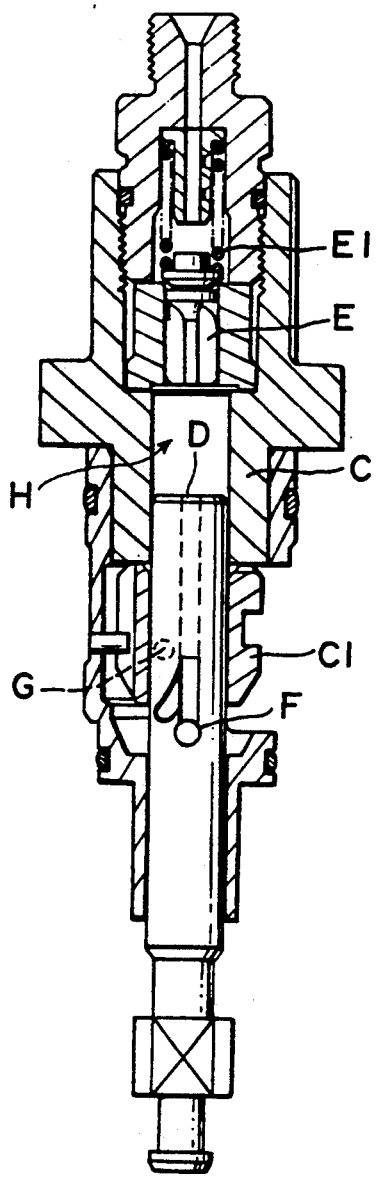
FIG. 11 is a cross-sectional view showing the structure of a pump element for the in-line fuel injection pump of FIG. 10.
Figure 12:
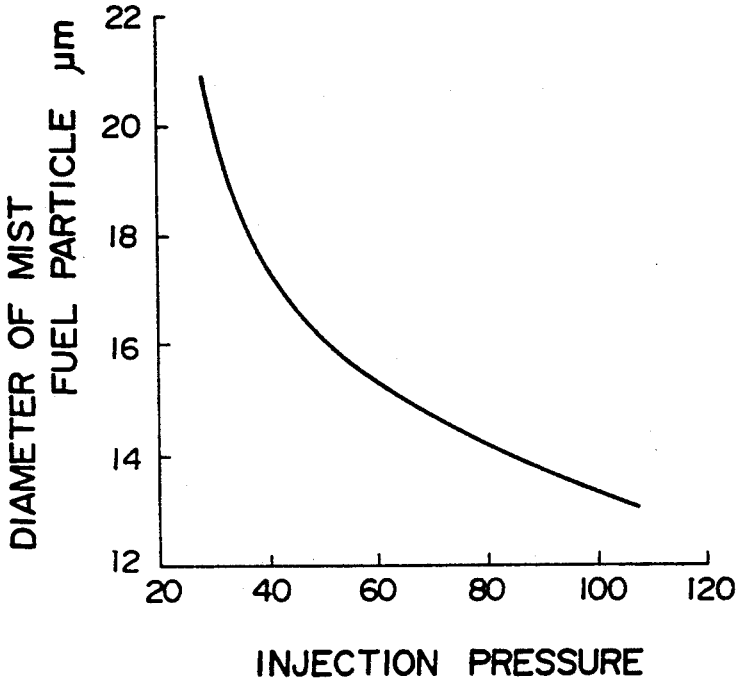
FIG. 12 shows the relationship between a diameter of fuel particles and the quantity of fuel to be injected.
Figure 13:
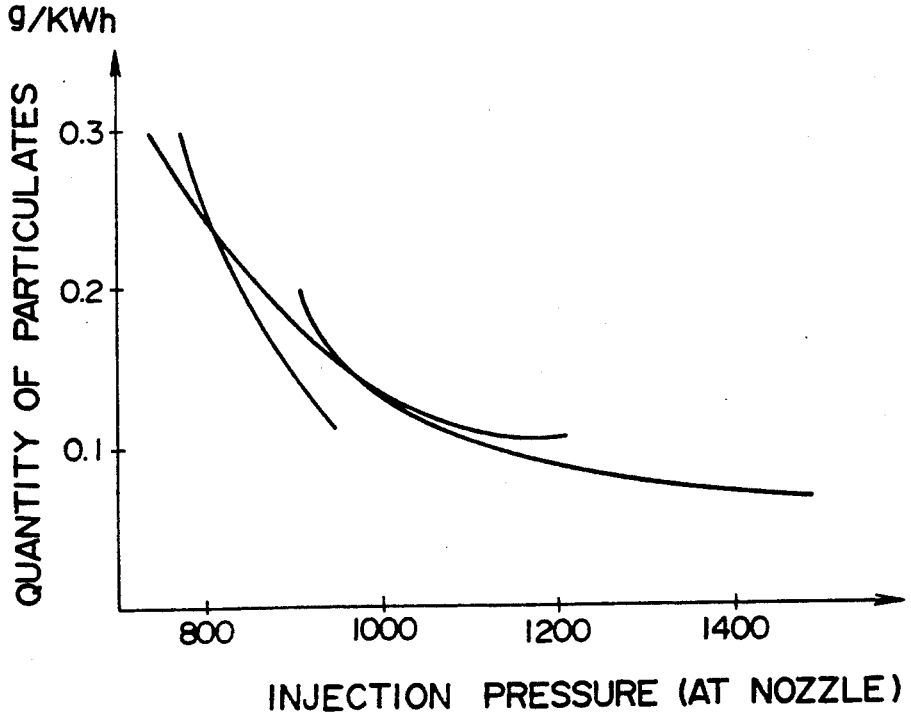
FIG. 13 shows the relationship between the injection pressure and the quantity of particulates in an exhaust gas.
Figure 14:
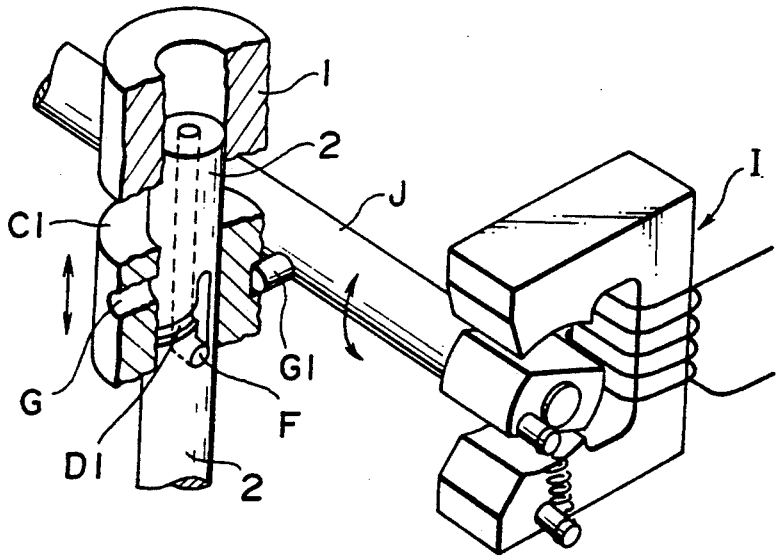
FIG. 14 is a perspective view showing concept of a pre-stroke mechanism for the fuel injection pump according to the present invention.

A member for controlling the quantity of fuel injection functions to turn the plunger 2 axially thereon, and includes a lever L as shown in FIG. 10.

FIGS. 15(A) to 15(D) show the process for feeding fuel under pressure according to the positional relationship between the control sleeve C1 and the plunger reed D1 which is a slanted groove.

Figure 15A:
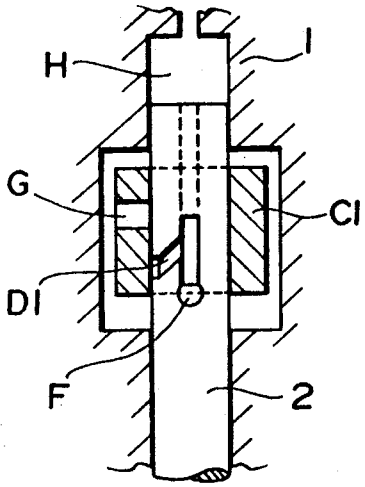
FIGS. 15(A) to FIG. 15(D) show the operation of the pre-stroke mechanism of FIG. 14.

FIG. 15(A) shows that a suction port F of the plunger 2 is in communication with the fuel chamber. Under this condition, no fuel is fed under pressure because the pressure is not high enough in a pressurization chamber H at the plunger top.

Figure 15B:
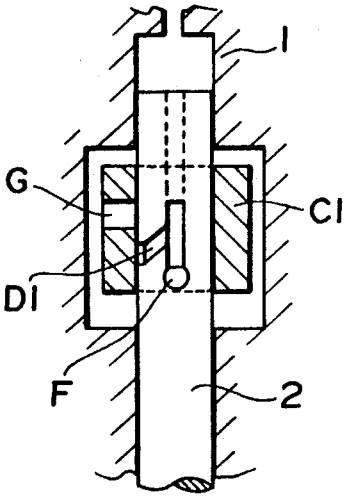

Referring to FIG. 15(B), the port F of the plunger 2 is blocked by the control sleeve C1. Under this condition, the pressure in the pressurization chamber H is raised to start fuel feeding.

Figure 15C:
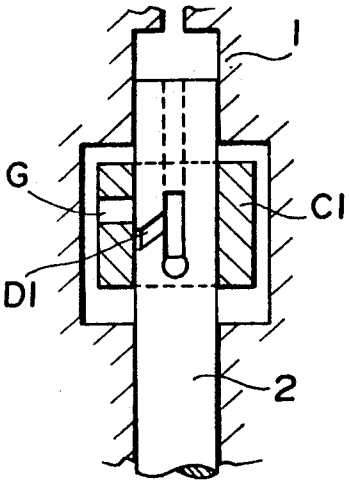

As shown in FIG. 15(C), the plunger is lifted with its port F and the plunger reed D1 blocked by the control sleeve C1. Fuel is being fed during the upward stroke of the plunger 2.

Figure 15D:
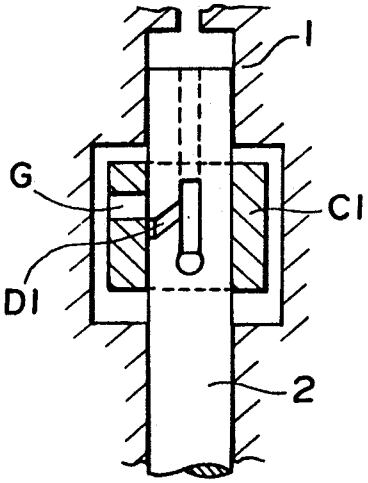

FIG. 15(D) shows that the plunger reed D1 is in communication with the spill port G of the control sleeve C1. Under this condition, fuel under pressure is introduced into the fuel chamber via the spill port G, the pressure is reduced in the pressurization chamber H, and the fuel feeding is completed.

The plunger reed D1, a vertical groove D2 and the port F constitute a control groove.

Figure 16:
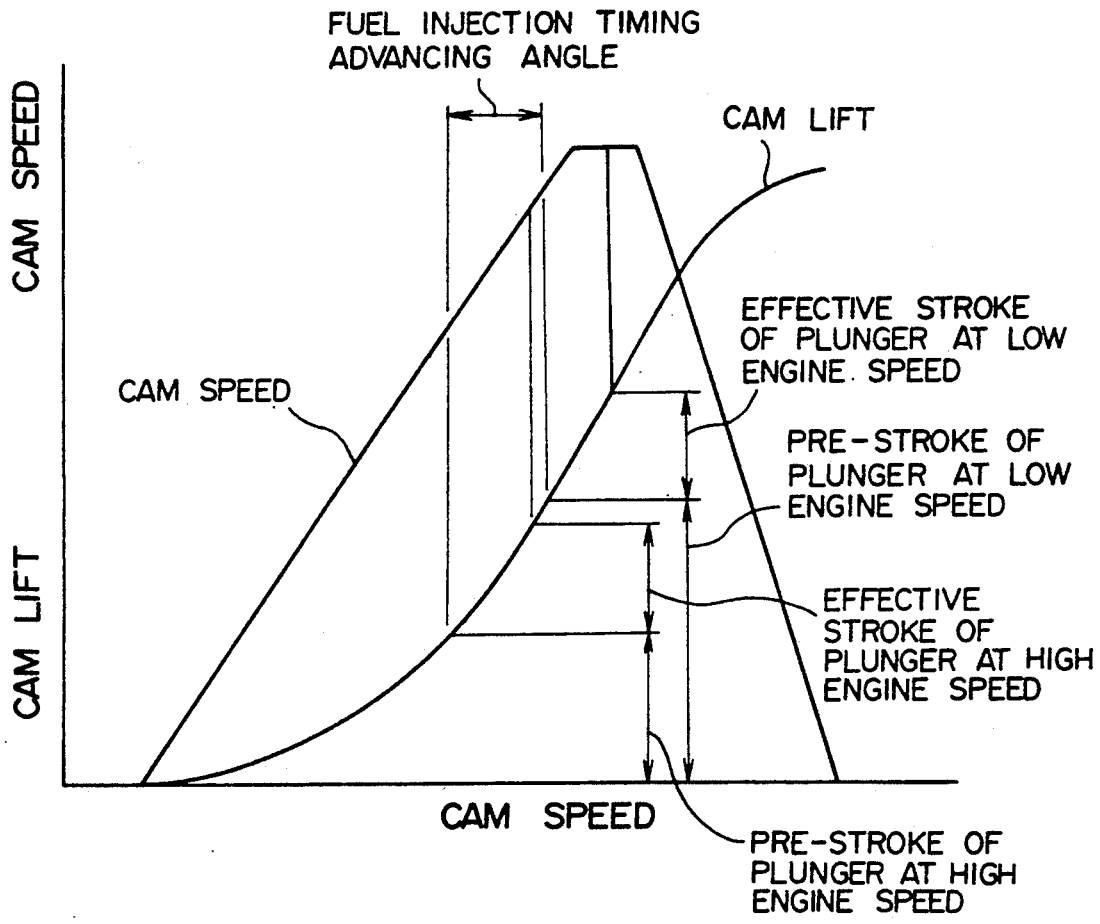
FIG. 16 shows operation characteristics of the pre-stroke mechanism of FIG. 16.

The position of the control sleeve C1 is selectively determined according to the engine speed. As shown in FIG. 16, when the engine speed is low, the pre-stroke of the plunger is increased to accelerate the movement of the plunger to improve the fuel feeding rate. On the contrary, when the engine speed is high, the pre-stroke of the plunger is reduced to maintain the fuel feeding rate as usual.

Referring back to FIG. 1, a passage 1B is formed in the plunger barrel 1, serving as a fluid feed member, and having an opening at one end of a flange 1A of the plunger barrel 1.

The passage 1B extends between the delivery valve chamber 3A which functions as a pressurization chamber for closing the delivery valve 3 and the plunger 2 in contact with a base circle of a cam. The passage 1B includes a first passage 1B1 extending between the flange 1A and the top of the plunger 2 in contact with the base circle of the cam, and a second passage 1B2 extending between a position confronting the first passage 1B1 via the plunger 2 and the delivery valve chamber 3A via an interior of a valve sheet 3 of the delivery valve 3.

The plunger 2 has an annular groove 2A on its circumference surface. The annular groove 2A constitutes a part of the passage 1B and functions to open and close passage 1B as the fluid feed path. A chamber C is formed on the inner surface of the plunger barrel 1 facing with the annular groove 2A so as to keep fuel.

An annular groove 3C is formed on a lower surface of the valve sheet 3B of the delivery valve 3, and is in communication with the first passage 1B1 and the second passage 1B2. The circumferential groove 3C is located at a position to seal the plunger barrel 1 and the delivery valve 3 when the delivery valve 3 is fitted into the plunger barrel 1.

When the plunger 2 is in contact with the base circle of the cam, the first passage 1B1 and the second passage 1B2 are in communication with each other as shown in FIG. 1. On the other hand, these passages 1B1 and 1B2 are out of communication with each other when the plunger 2 is in contact with another portion of the cam and is lifted.

Figure 4B:
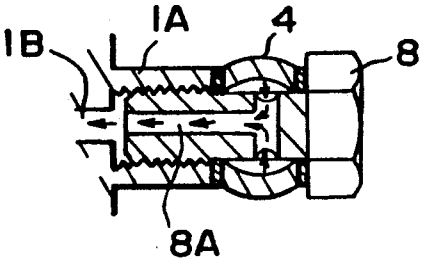
FIG. 4(B) is a cross-sectional view of the injection pump taken on a plane indicated by and viewed in the direction B—B of FIG. 4(A).
Figure 4A:
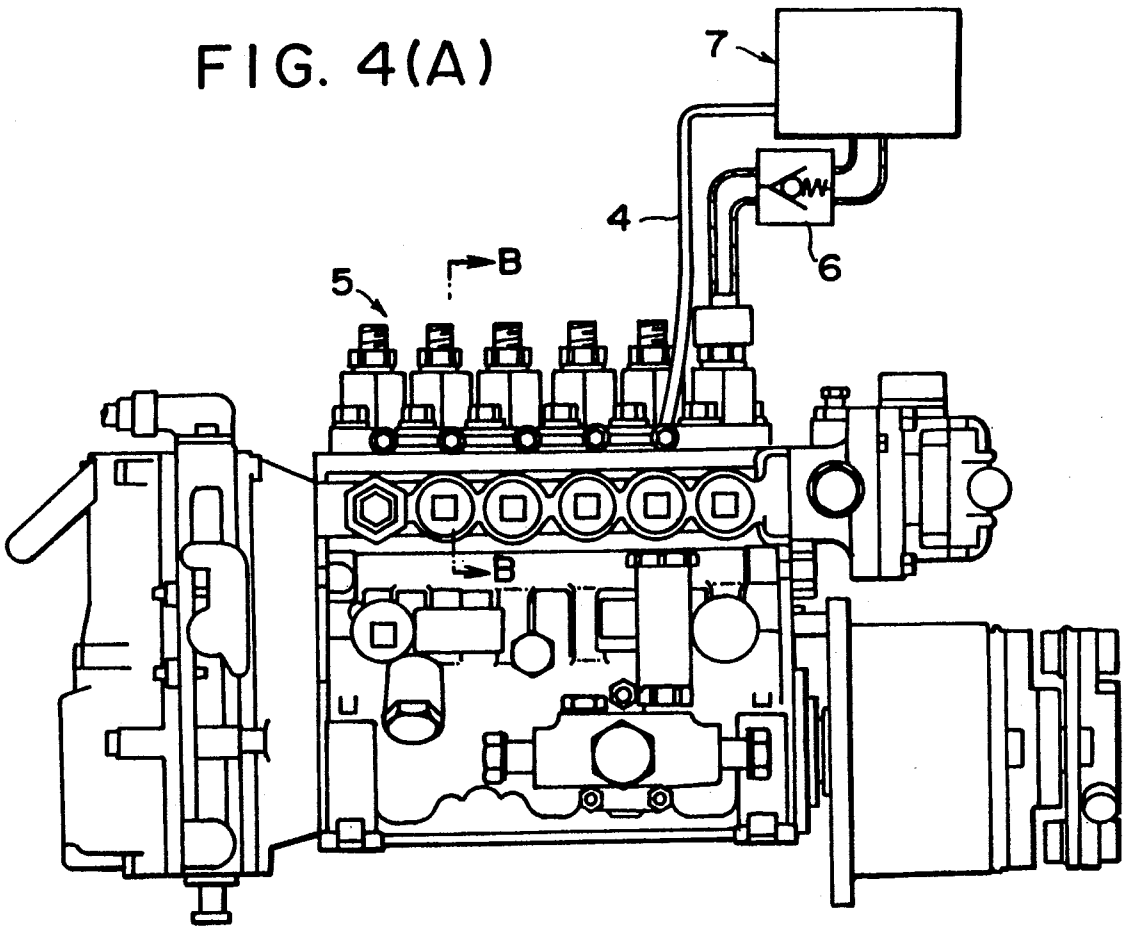
FIG. 4(A) shows an injection pump including the pump element of FIG. 1.

The passage 1B is in communication with a fuel supply pipe 4 via an opening near the flange 1A. As shown in FIGS. 4(A) and 4(B), the fuel supply pipe 4 is in communication with one of the plunger barrels of the injection pump 5. The plunger barrel houses the pump element serving as a preliminary pressurization pump for one cylinder.

The pump element shown in FIG. 4(A) is the same as that of the conventional fuel injection system. Fuel fed under pressure by the plunger is adjusted its pressure by an accumulator 7 including a regulator valve and a fuel tank (not shown), and is fed to the fuel supply pipe 4 via a non-return valve 6.

The fuel supply pipe 4 and the flange 1A (shown in FIG. 1) communicate with each other via a bolt 8, so that fuel is supplied to the passage 1B via a throughbore 8A in the bolt 8.

When the plunger 2 is in contact with the base circle of the cam, the circumferential groove 2A of the plunger 2 in communication with chambers 1C of the plunger barrel at the opposite ends of the groove 2A.

Fuel from the pump element corresponding to one cylinder of the fuel injection pump 5 is adjusted pressure thereof by the accumulator 7, and is introduced into the delivery valve chamber 3A via the passage 1B. Therefore, the pressure in the delivery valve chamber 3A is set to the adjusted value.

The pressure of fuel delivered to the delivery valve chamber 3A via the passage IB is set to a value which is lower than the pressure for opening the injection nozzle, and is also lower than the pressure applied to fuel by the moving plunger 2. The pressure of fuel to the delivery valve chamber 3A serves as a preliminary pressure to be added to the pressure for opening the delivery valve 3 and determined by the return spring of the delivery valve 3, thereby raising a pressure for opening the delivery valve 3.

Figure 5:
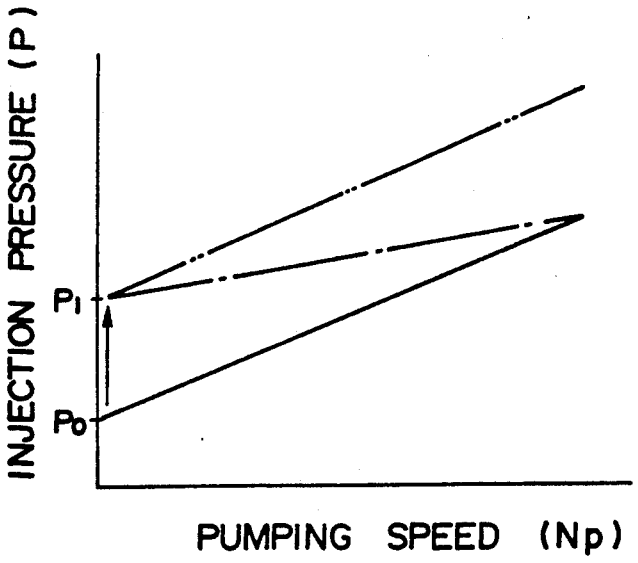
FIG. 5 is a graph showing the relationship between the injection pressure and pumping speed.
Figure 3:
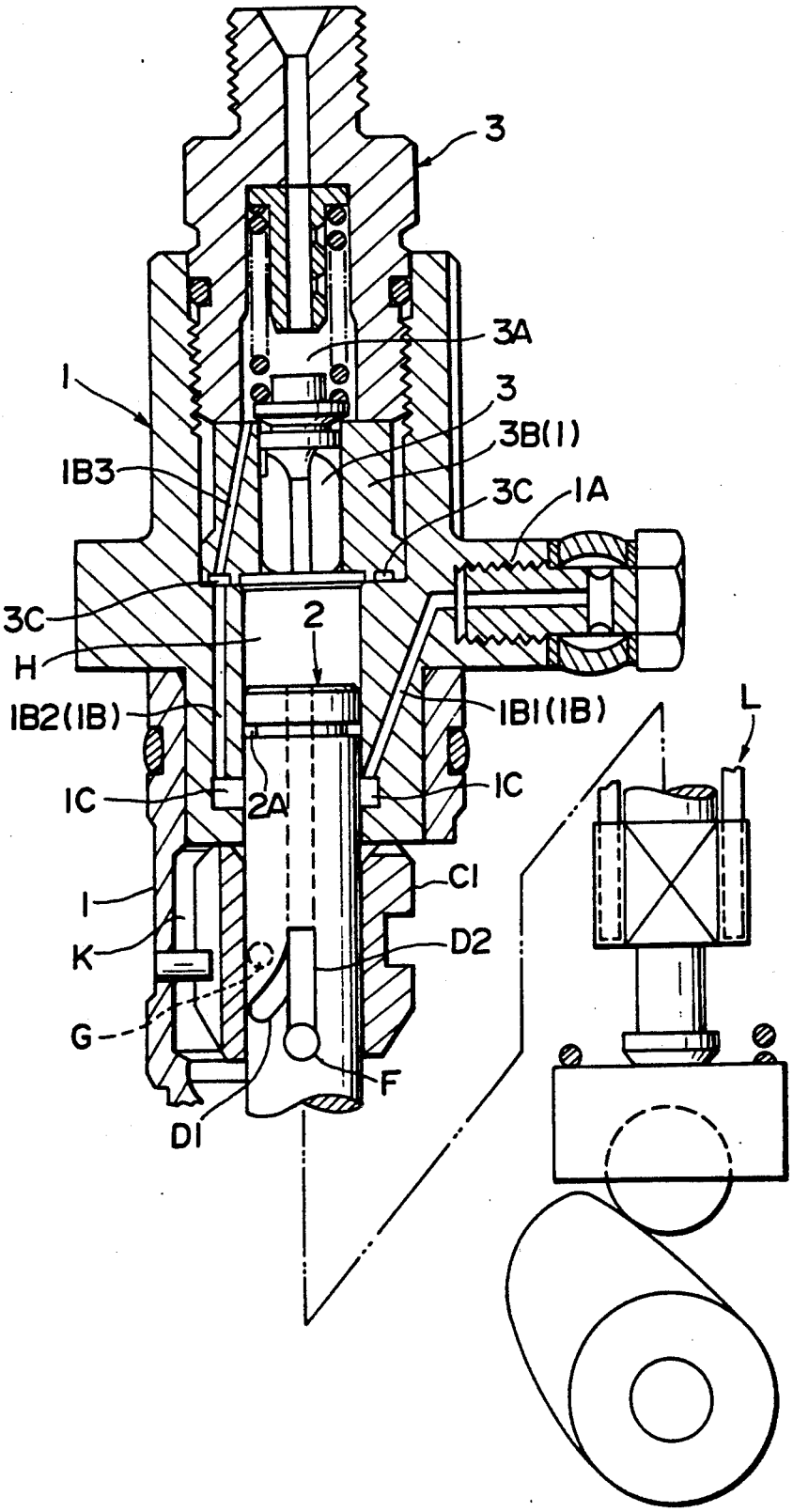
FIG. 3 is a cross-sectional view showing the operation of the pump element of FIG. 1.

As shown in FIG. 5, the injection pressure ($P_0$), which is determined for a low engine speed by the return spring of the delivery valve 3, is raised to a pressure ($P_1$).

Therefore, fuel supplied to the delivery valve chamber 3A can raise the pressure for opening the delivery valve 3 at the low engine speed, so that fuel can be extensively changed to fine fuel particles by increasing the injection pressure according to a moving speed of the plunger 2.

When the plunger 2 is in contact with the cam at a portion other than the base circle thereof so as to pressurize fuel, the circumferential groove 2A of the plunger 2 is out of communication with the chamber C of the passage 1B.

Therefore, no fuel is supplied to the passage 1B. Fuel supplied to the delivery valve chamber 3A is confined in the passage 1B, thereby preventing the pressure of the delivery valve chamber 3A from being reduced.

In this embodiment, the passage 1B used to raise the pressure in the delivery valve chamber 3A is disconnected when the plunger 2 is in contact with the cam at a portion other than the base circle thereof. No fuel is returned to the accumulator 7 from the fuel supply pipe 4 even when the pressure in the pressurization chamber H is raised by the opened delivery valve 3 and the pressure in the delivery valve chamber 3A is raised. Therefore, the injection pressure can be raised while the fuel feed pressure is kept at the predetermined value.

The passage 1B at the side of the delivery valve 3 and the passage 1B at the plunger barrel 1 are in communication with each other at the position where the delivery valve 3 and the plunger barrel 1 are most effectively sealed from each other. Therefore, no additional sealing structure is necessary to prevent leakage of fuel for preliminary pressurization.

The pressure of fuel delivered to the delivery valve chamber 3A is not always set by the pump element of the fuel injection pump 5 and the accumulator 7, and can be changed according to the engine operating conditions.

Figure 6A:
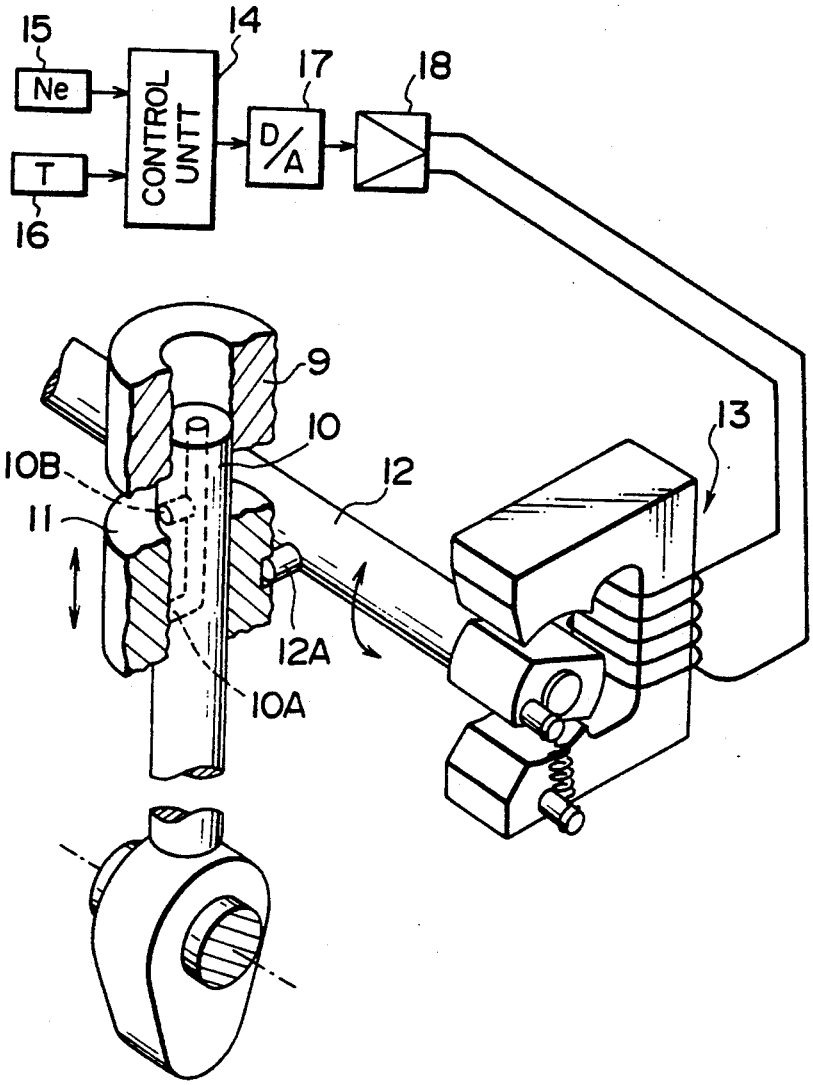
FIG. 6(A) is a perspective view showing a mechanism for generating a preliminary pressure in a delivery valve chamber of the injection pump of FIG. 4.

FIG. 6(A) shows a structure of a pump element for varying the pressure of fuel to be introduced to the passage 1B. The pump element includes a control sleeve 11 which is housed in a plunger barrel 9 and is axially slidable in a plunger 10, and a driver 13 for displacing the control sleeve 11.

The control sleeve 11 and the driver 13 become cooperative when a pin 12A fixed on a control rod 12 is fitted into a cavity formed on the control sleeve 11. The control sleeve 11 is axially moved on the plunger 10 in response to the turning of the control rod 12 so as to change the pre-stroke of the plunger 10. The control rod 12 is operated by a rotary solenoid 13, for example.

Figure 6B:
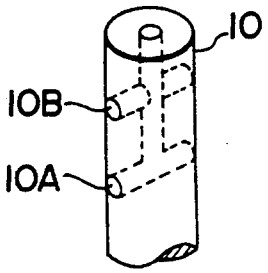
FIG. 6(B) shows a modification of the plunger shown in FIG. 6(A).
Figure 6C:
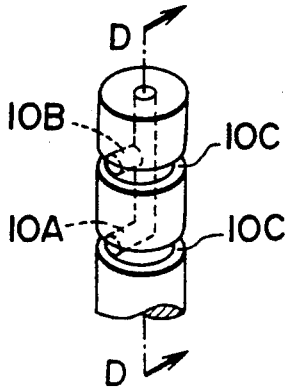
FIG. 6(C) shows another modification of the plunger.
Figure 6D:
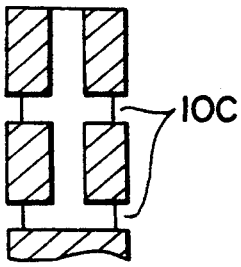
FIG. 6(D) is a cross-sectional view of the plunger taken on a plane indicated and viewed in the direction of the arrows D—D of FIG. 6(C).

The plunger 10 does not always have a pair of fuel escape ports which extend radially in the plunger 10 in one direction (called "first and second escape ports 10A and 10B", respectively) as shown in FIG. 6(A). These escape ports 10A and 10B may be constructed as shown in FIGS. 6(B) to 6(D). FIG. 6(B) shows that the escape ports 10A and 10B terminate at symmetrical positions on the plunger surface. As shown in FIGS. 6(C) and 6(D), the plunger 10 has annular groves 10C on the surface thereof at positions corresponding to the ends of the escape ports 10A and 10B. The fuel pressure can be abruptly changed to improve transient response at the beginning or end of fuel feeding under pressure.

FIGS. 7(A) to 7(D) show the process for feeding fuel under pressure according to the positional relationship between the control sleeve 11 and the ports in the plunger shown in FIG. 6(A).

Figure 7A:
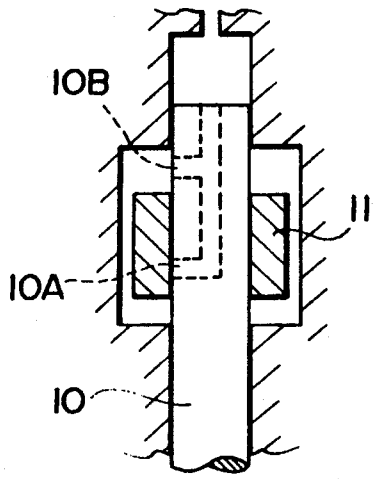
FIGS. 7(A) to FIG. 7(D) show the operation of the preliminary pressure generating mechanism.

FIG. 7(A) shows that the first fuel escape port of the plunger 10 is blocked by the control sleeve 11 while the second fuel escape port 10B is in communication with the fuel chamber. Under this condition, no fuel is fed under pressure since the pressure in the pressurization chamber atop the plunger is not raised.

Figure 7B:
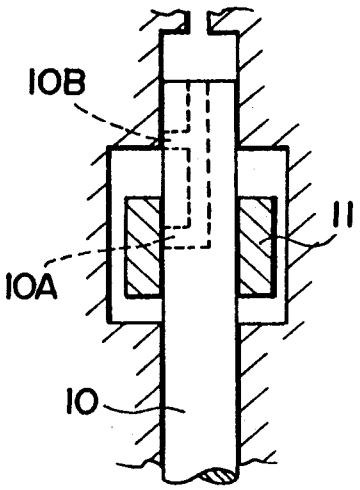

FIG. 7(B) shows the moment when the second fuel escape port 10B of the plunger 10 is blocked by the plunger barrel 9 and the first fuel escape port 10A is blocked by the control sleeve 11. Under this condition, the pressurization chamber of the plunger is further pressurized to start fuel feeding under pressure.

Figure 7C:
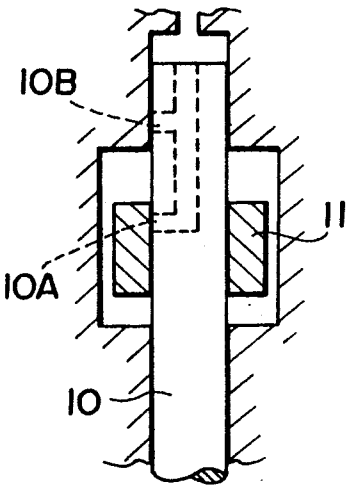

Referring to FIG. 7(C), the plunger 10 continues its upstroke with its first and second fuel escape ports 10A and 10B blocked, so that fuel is being fed under pressure.

Figure 7D:
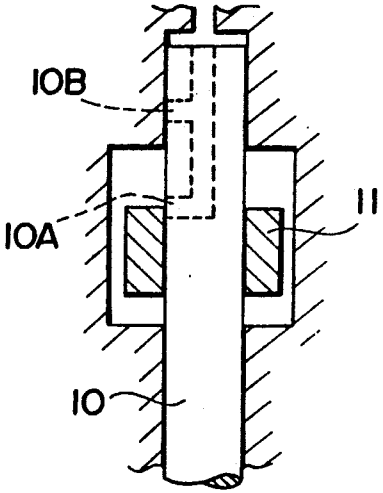
Figure 8:
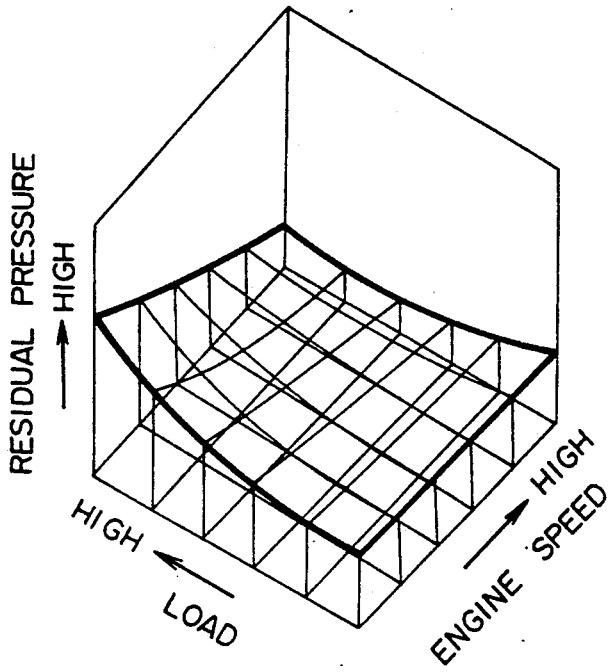
FIG. 8 shows the characteristics of a control unit for the preliminary pressure generating mechanism of FIG. 6.

FIG. 7(D) shows the moment when the first fuel escape port 10A of the plunger 10 is communication with the fuel chamber. Under this condition, fuel pressurized by the plunger 10 is discharged into the fuel chamber via the fuel escape port 10A. Thus, the pressure is reduced in the pressurization chamber, thereby completing fuel feeding under pressure.

When the control rod 12 turns in the direction to ascend the control sleeve 11, fuel is further pressurized by the plunger 10, so that more fuel is discharged. Reverse turning of the control rod 12 reduces the pressure applied to fuel, so that the quantity of discharged fuel is reduced accordingly.

The extent to which the control rod 12 is turned is controlled by the control unit 14 used for setting a current for energizing a solenoid 13.

The control unit 14 is connected at its input side to an engine speed sensor 15 and an engine torque sensor 16, and is connected at its output side to a driver 18 of the solenoid 13 via a digital to analog converter 17.

The control unit 14 has a map for setting an optimum residual pressure according to the engine speed and the engine torque, and selects the optimum residual pressure in response to signals from the foregoing sensors.

The residual pressure ($P_R$) is set as follows so as to prevent cavitation and a secondary or abnormal fuel injection after the main fuel injection at the time of the pumping or discharging stroke.

$$0(\mathrm{Kg/cm^2}) < P_R < \text{nozzle opening pressure}$$

It is possible to use a stepping motor 19 as an actuator for the control unit 14 to turn the control rod 19. In such a case, the control unit 14 can perform digital control.

Figure 9:
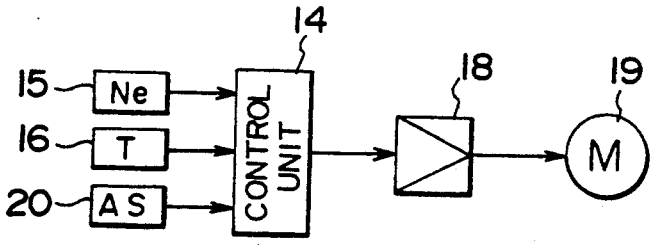
FIG. 9 is a block diagram showing another preliminary pressure generating mechanism for the delivery valve of FIG. 9.

With the foregoing structure, the residual pressure is controlled to vary the pressure for opening the delivery valve 3, thereby raising the injection pressure. In FIG. 9, a position sensor 20 functions to detect the turning extent of the control rod 12 turned by the stepping motor 19, or a position to which the control sleeve 11 is displaced. The displacement of the control sleeve 11 can be subject to feed-back control by this sensor 20.

Therefore, even when the engine changes its operating condition suddenly, its output can be kept as usual. For example, even when the engine speed is suddenly reduced, it is possible to suppress the quantity of toxic components in the exhaust gas. Thus, the engine can improve its transient response depending upon its operating situation.

Fuel to be supplied to the delivery valve chamber is used only to control the residual pressure in the delivery valve chamber. Therefore, the quantity of fuel to be supplied may vary with a variation of the pressure in the delivery valve chamber when fuel feeding is started. However, this variation of the fuel amount is negligible. Further, a small pump is enough as a pressure source. Fuel for preliminary pressurization of the delivery valve chamber may be different from fuel which is fed to the pressurization chamber H atop the plunger 10.

The foregoing mechanism for varying the prestroke of the plunger can be operated with less power than the conventional mechanism for rotating the plunger which includes a control rack and a control pinion.

The positional relationship between the spill port of the control sleeve and the plunger reed can be changed without complicatinting the diameter and size of the fuel escape ports compared with the case in which this positional relationship is controlled by rotating the control sleeve.

According to this invention, fuel for controlling the residual pressure in the delivery valve chamber is supplied to the delivery valve chamber via a part of the plunger which is in contact with the base circle of the cam and via the passage which is different from the passage for supplying fuel to be burned so as to operate the engine. Fuel under the preset pressure is supplied to the delivery valve chamber from the pressure source before the delivery valve is opened, thereby increasing pressures in the fuel injection pipe and the delivery valve chamber. Thus, the pressure necessary for opening the delivery valve can be increased.

Since the foregoing passage is blocked when the plunger is in contact with the cam at a portion except for the base circle thereof, the pressure in the pressurization chamber is increased by the upstroke of the plunger. Therefore, the pressure in the delivery valve chamber is not lowered even after the delivery valve is opened.

When the engine speed is low, the pressure in the pressurization chamber is reduced, but the injection pressure is raised by increasing the pressure for opening the delivery valve. Thus, fuel can be changed into fine fuel particles. Therefore, such fine fuel particles can be completely burned, thereby reducing particulates in the exhaust gas.

Further, fuel is supplied to the delivery valve chamber by using one of the pump elements in the fuel injection pump without the provision of an additional pump for this purpose. Therefore, generation of toxic articles in the exhaust gas can be suppressed without making the fuel injection pump complicated and bulky.

What is claimed is:

1. A fuel injection system comprising:

a housing;

a pressurization chamber and a delivery valve chamber housed in the housing;

a delivery valve for making the pressurization chamber and the delivery valve chamber in and out of communication with each other, the delivery valve being urged to close by a spring;

a plunger slidably disposed in the housing, the plunger being at its one end in communication with the pressurization chamber and being operated at its other end by a cam driven by an engine;

a fuel chamber housed in the housing so as to surround the plunger;

a control sleeve housed in the fuel chamber and being slidable on an outer surface of the plunger;

a control groove formed on the plunger, the control groove being in communication with the pressurization chamber at one end thereof and having the other end thereof opened on the outer circumferential surface of the plunger;

a control port formed on the control sleeve, and for connecting and disconnecting the fuel chamber and the pressurization chamber in cooperation with the control groove;

a member for controlling the quantity of fuel to be injected, and being supported by the housing;

an injecting timing control member for controlling fuel injection timing and being supported by the housing;

an opening/closing means for opening and closing a fluid passage and being formed on the outer circumferential surface of the plunger with a predetermined space from the control groove;

a fluid feed means having one end communicating with a pressurization pump and the other end thereof communicating with the delivery valve chamber via the opening/closing means when the plunger is in contact with a base circle of the cam; and a control unit for controlling the pressurization pump so as to control a residual pressure in the delivery valve chamber.

2. A fuel injection system of claim 1, wherein the fluid feed means is out of communication with the opening/-closing means when the plunger is in contact with the cam at a position other than the base circle thereof.

3. A fuel injection system of claim 1, wherein the opening/closing means is an annular groove formed on the outer circumferential surface of the plunger.

4. A fuel injection system of claim 1, wherein the fluid feed means includes a pair of chambers which are formed on the housing so as to confront with the fluid feed means when the plunger is in contact with the base circle of the cam.

5. A fuel injection system of claim 1, wherein the housing houses the delivery valve and includes a valve sheet disposed between the pressurization chamber and the delivery valve chamber, and the fluid feed means includes an annular groove formed on a lower surface of the valve sheet.

6. A fuel injection system of claim 1, wherein the control unit includes an optimum residual pressure map according to an engine speed and an engine load, and receives data from an engine speed sensor and an engine torque sensor, and operates the pressurization pump to obtain an optimum residual pressure from the map based on the received data.

7. A fuel injection system of claim 6, wherein the map is set to increase the residual pressure as the load becomes higher at a low engine speed.

8. A fuel injection system of claim 6, wherein the map is set to gradually lower the residual pressure as the load becomes higher at a high engine speed.

9. A fuel injection system of claim 6, wherein the map is set to lower the residual pressure as the engine speed becomes higher at a high engine load.

10. A fuel injection system of claim 6, wherein the map is set to keep the residual pressure substantially constant at a low load regardless of the engine speed.

11. A fuel injection system of claim 1, wherein the control unit sets the pressure of fuel to be fed to the delivery valve chamber from the fluid feed means to be lower than the pressure for opening an injection nozzle.

12. A fuel injection system of claim 1, wherein the control unit sets the pressure of fuel to be fed to the delivery valve chamber from the fluid feed means to be lower than the pressure of fuel pressurized in the pressurization chamber by movement of the plunger.

13. A fuel injection system of claim 1, wherein the control groove includes a groove slanting axially of the plunger and a longitudinal groove along the axis of the plunger.

14. A fuel injection system of claim 1, wherein the fuel injection amount control member functions to turn the plunger with respect to the control sleeve.

15. A fuel injection system of claim 1, wherein the injection timing control member functions to slide the control sleeve axially of the plunger.

16. A fuel injection system of claim 15, wherein the injection timing control member uses a rotary solenoid as a drive source for turning the control sleeve.

17. A fuel injection system of claim 1, wherein the injection timing control member advances fuel injection timing when the engine speed is high.

18. A fuel injection system of claim 1, wherein the injection timing control member increases a prestroke of the plunger when the engine speed is low.

19. A fuel injection system of claim 1 including a plurality of in-line fuel injection pumps.

20. A fuel injection system of claim 1, wherein the delivery valve chamber receives via the fluid feed means fuel which is different from fuel to be fed from the pressurization chamber.

21. A fuel injection system of claim 1, wherein the pressurization pump is slidably disposed in the housing, and comprises: a plunger which is at its one end in communication with the pressurization chamber and is operated at its other end by the cam driven by the engine; a fuel chamber housed in the housing so as to surround the plunger; a control sleeve housed in the fuel chamber and being slidable on the outer circumferential surface of the plunger; a control groove which is formed on the plunger, is in communication with the pressurization chamber at one end thereof and has the other end thereof opened on the outer circumferential surface of the plunger; and a member for controlling the quantity of fuel to be injected and being supported by the housing.

22. A fuel injection system of claim 21, wherein the control groove have two ports, one of which is used to feed fuel to the pressurization chamber, and the other of which is used to discharge fuel from the pressurization chamber.

23. A fuel injection system of claim 22, wherein the fuel feed port is a throughbore in the plunger and the fuel discharge port is a throughbore in the plunger.

24. A fuel injection system of claim 22, wherein the fuel feed port is in communication with an annular groove on the outer circumferential surface of the plunger, and the fuel feed port is in communication with another annular groove on the outer circumferential surface of the plunger.

25. A fuel injection system of claim 21, wherein the pressurization pump uses a rotary solenoid as a drive source for turning the control sleeve.

26. A fuel injection system of claim 21, wherein the pressurization pump uses a stepping motor as a drive source for turning the control sleeve.

27. A fuel injection system of claim 21, wherein the control unit calculates the amount of turning of the control sleeve based on data from a position sensor, and performs feedback control of the position of the control sleeve.

28. A method for controlling the residual pressure in a fuel injection pump of a fuel injection system, comprising the steps of:

(a) closing a delivery valve by a spring so that a pressurization chamber and a delivery valve chamber housed in a housing are made to be in and out of communication with each other;

(b) operating a plunger slidably disposed in said housing at a first end of said plunger by a cam driven with an engine which is in communication with said pressurization chamber at a second end of said plunger opposite to said first end;

(c) surrounding said plunger with a fuel chamber housed in said housing;

(d) sliding a control sleeve housed in said fuel chamber on an outer circumferential surface of said plunger;

(e) communicating a control groove formed on said plunger with said pressurization chamber at a first end of said control groove and opening a second end of said control groove opposite to said first end on said outer circumferential surface of said plunger;

(f) connecting and disconnecting said fuel chamber and said pressurization chamber in cooperation with said control groove by a control port formed on said control sleeve;

(g) controlling the quantity of fuel to be injected by a member supported by said housing;

(h) controlling fuel injection timing by an injection timing control member supported by said housing;

(i) opening and closing a fluid passage by opening/-closing means formed on said outer circumferential surface of said plunger at a predetermined space from said control groove;

(j) communicating a first end of fluid feed means with a pressurization pump and a second end of said fluid feed means opposite to said first end with said delivery valve chamber via said opening/closing means when said plunger is in contact with a base circle of said cam; and (k) controlling said pressurization pump by a control unit so as to control a residual pressure in said delivery valve chamber.

29. A method of claim 28, wherein said fluid feed means is out of communication with said opening/closing means when said plunger is in contact with said cam at a position other than said base circle thereof.

30. A method of claim 28, wherein said step (k) further includes the steps of receiving data from an engine speed sensor and an engine torque sensor and operating said pressurization pump to obtain an optimum residual pressure from an optimum residual pressure map based on the data received from said engine speed sensor and said engine torque sensor.

31. A method according to claim 30, wherein said optimum residual pressure map is set to increase the residual pressure as the load becomes higher at low engine speeds.

32. A method according to claim 30, wherein said optimum residual pressure map is set to gradually lower the residual pressure as the load becomes higher at high engine speeds.

33. A method according to claim 30, wherein said optimum residual pressure map is set to lower the residual pressure as the engine speed becomes higher at high engine loads.

34. A method according to claim 30, wherein said optimum residual pressure map is set to keep the residual pressure substantially constant at low loads regardless of the engine speed.

35. A method according to claim 28, wherein said step (k) further includes the step of setting the pressure of fuel to be fed to said delivery valve chamber from said fluid feed means to be lower than the pressure for opening an injection nozzle.

36. A method according to claim 28, wherein said step (k) further includes the step of setting the pressure of fuel to be fed to said delivery valve chamber from said fluid feed means to be lower than the pressure of fuel pressurized in said pressurization chamber by movement of said plunger.

37. A method according to claim 28, wherein said step (h) functions to turn said plunger with respect to said control sleeve.

38. A method according to claim 28, wherein said step (h) functions to slide said control sleeve axially of said plunger.

39. A method according to claim 28, wherein said step (h) advances said fuel injection timing when the engine speed is high.

40. A method according to claim 28, wherein said step (h) increases a prestroke of said plunger when the engine speed is low.

* * * * *